US012331737B1

(12) United States Patent
Ruiz

(10) Patent No.: US 12,331,737 B1
(45) Date of Patent: Jun. 17, 2025

(54) SUCKER ROD GUIDE TO REDUCE TURBULENCE

(71) Applicant: TRC Services, Inc., The Woodlands, TX (US)

(72) Inventor: Rodrigo Ariel Ruiz, Tomball, TX (US)

(73) Assignee: TRC Services, Inc., The Woodlands, TX (US)

( * ) Notice: Subject to any disclaimer, the term of this patent is extended or adjusted under 35 U.S.C. 154(b) by 0 days.

(21) Appl. No.: 18/593,770

(22) Filed: Mar. 1, 2024

(51) Int. Cl.
*F04B 47/02* (2006.01)
*E21B 43/12* (2006.01)

(52) U.S. Cl.
CPC ..... *F04B 47/026* (2013.01); *E21B 43/127* (2013.01)

(58) Field of Classification Search
CPC .. F04B 47/026; E21B 43/127; E21B 17/1071; E21B 17/1078
See application file for complete search history.

(56) References Cited

U.S. PATENT DOCUMENTS

| | | | | |
|---|---|---|---|---|
| 4,858,688 | A | 8/1989 | Edwards et al. | |
| 5,115,863 | A | 5/1992 | Olinger | |
| 5,191,938 | A | 3/1993 | Sable et al. | |
| 5,358,041 | A | 10/1994 | O'Hair | |
| 5,487,426 | A | 1/1996 | O'Hair | |
| 5,492,174 | A | 2/1996 | O'Hair | |
| 5,873,157 | A | 2/1999 | Hart et al. | |
| 6,065,537 | A | 5/2000 | Evans et al. | |
| 9,200,489 | B1 | 12/2015 | Mabry | |
| 9,926,754 | B2 | 3/2018 | Pereyra et al. | |
| D910,722 | S | 2/2021 | Nommensen | |
| 11,261,673 | B2 | 3/2022 | Martin | |
| 2006/0201670 | A1* | 9/2006 | Stewart | E21B 17/18 166/170 |
| 2019/0316430 | A1 | 10/2019 | Rutledge | |
| 2022/0018195 | A1 | 1/2022 | Nommensen | |
| 2023/0220735 | A1 | 7/2023 | Bahemia et al. | |

OTHER PUBLICATIONS

Lufkin, "Rod Guides," Brochure, dated Jul. 6, 2023.
Norris, "PEEK-blend rod guides extend service life in high-temperature wells," Brochure, copyright 2022, dated Apr. 20, 2022.
Nov, "Tuboscope: Sucker Rod Services," Brochure, copyright 2018.
Nov, "Turboscope: Optimize Asset Value and Maximize Production Efficiency," Brochure, copyright 2019.
PCM, "Rod Centralizers," Brochure, undated, obtained from wwww.pcmals.com on Feb. 15, 2024.
Weatherford, "Sucker Rod Guides," Brochure, copyright 2016.

* cited by examiner

*Primary Examiner* — James G Sayre
(74) *Attorney, Agent, or Firm* — Cabello Hall Zinda, PLLC

(57) ABSTRACT

A sucker rod guide is used on a sucker rod within production tubing. The guide includes a sleeve having multiple vanes. The sleeve is designed to fit onto the sucker rod and includes ends, an outer surface, and a particular length and diameter along its axis. The vanes are evenly distributed about the sleeve and protrude outwardly to a defined diameter. Each vane exhibits symmetry along longitudinal and lateral axes, with distinct characteristics. Sidewalls at each end of each vane diverge from one another and extend to a midpoint of symmetry. Angled faces at each end of each vane extend at an angle from the sleeve's surface, and each vane has an external face that has a diamond shape. The guide is configured to reduce turbulence adjacent the sucker rod near the edge of the guide.

27 Claims, 11 Drawing Sheets

(Reference Art)

(Reference Art)

(Reference Art)

(Reference Art)

FIG. 12A (Reference Art)

FIG. 12B (Reference Art)

FIG. 12C (Reference Art)

FIG. 12D (Reference Art)

(Reference Art)

(Reference Art)

SUCKER ROD GUIDE TO REDUCE TURBULENCE

BACKGROUND OF THE DISCLOSURE

Sucker rods used in reciprocating rod lift applications can use one or more sucker rod guides to guide the sucker rods. The main purpose of a sucker rod guide has been to prevent metal-to-metal contact of sucker rod couplings (i.e., the connection of the sucker rods) with the interior of the production tubing. The couplings and the tubing are typically made of steel, and the guides can help to center the sucker rod string in the production tubing and can distance the rods from the tubing wall. The sucker rod guides have typically been made of a thermoplastic or a thermoset plastic and have been commonly used as a sacrificial component of the system to prevent the premature wear of the tubing's internal surface.

In recent years, new wells are being drilled with more complex wellbore geometries. These new well geometries have required more sucker rod guides to be used. Indeed, the more deviated a well is from vertical equates to an increased need to keep the sucker rod couplings from coming into contact with the tubing.

The increased use of sucker rod guides tied with high flow rate in the wells has created a different problem. The geometry of a sucker rod guide forces flow to go around it, which influences the turbulence generated before and after the guide. Therefore, when the sucker rod guides are in use on a rod string, the guides tend to generate a significant perturbance in the fluid flow in the tubing. The extent of this perturbance varies from geometry to geometry and depends on the flow characteristics of the well.

For example, turbulence can be produced in the fluid as the guide is moved during the pumping cycle (e.g., downstroke and upstroke). The change in flow characteristics in the periphery of the sucker rod guides generates several issues that lead to failure on the surface of the sucker rod. When the flow velocity is too high, the fluid will remove any corrosion deposits and accelerate localized corrosion. In other instances, the flow can be stagnant, preventing a corrosion inhibitor from forming a film to protect the sucker rod from corrosion. The corrosion in the area is evidenced as corrosion pits (localized depressions) or corrosion-erosion (widespread depression). These two types of imperfections will act as stress risers due to the fatigue load (axial and bending) to which the rod section is exposed, leading to a crack initiation and posterior sucker rod failure.

Rod guides typically have one or more flutes or channels, which are intended to allow the fluid to pass the guide. The flutes or channels are typically shaped to reduce the disruption of the fluid flow. Several shapes have been developed over the years, and many shapes seek to reduce damaging effects of turbulence by diminishing turbulence generated by the guide or by diminishing the drag force generated by the fluid.

An example of a low turbulence rod guide is disclosed in U.S. Pat. No. 5,115,863, which describes a guide offering minimum cross-section and turbulence without loss of erodible volume. The guide is described as being very long in relation to its diameter to facilitate laminar flow and a low drag coefficient.

Another rod guide is disclosed in U.S. Pat. No. 5,358,041, which describes a rod guide having blades with knife ends to reduce resistance to fluid flow about and through the rod guide and to reduce turbulent flow behind each blade. Yet another example of a rod guide is disclosed in U.S. Pat. No. 9,926,754, which describes a rod guide having a body with a polygonal cross-section and having a plurality of blades longitudinally disposed and extending from the body.

Although existing rod guides may be effective in preventing metal-to-metal contact and even in reducing turbulence, failures to sucker rods may still occur when some sucker rod guides of the prior art are used. The subject matter of the present disclosure is directed to overcoming, or at least reducing the effects of, one or more of the problems set forth above.

SUMMARY OF THE DISCLOSURE

Some implementations disclosed herein relate to an apparatus or system for a sucker rod used to lift fluid in production tubing, including a guide for use on the sucker rod. In one implementation, the guide includes a body configured to be positioned on the sucker rod, featuring an external surface, first and second body ends, and a first diameter. Additionally, the guide includes a plurality of vanes disposed around the body's external surface, extending radially outward to a second diameter, which is larger than the first diameter. Each vane is symmetrical about both a longitudinal line of symmetry and a lateral line of symmetry, which is at the midpoint of the longitudinal line. These vanes have adjacent sidewalls at each vane end, and the adjacent sidewalls diverge from each other from the vane end and extend to the lateral line of symmetry at the midpoint.

Moreover, the guide defines troughs with sides formed by the sidewalls of adjacent vanes. The sides of each trough near the first body end converge from the vane ends of adjacent vanes to a liminal constriction at the midpoint and then diverge directly from this constriction to the vane ends of the adjacent vanes towards the second body end.

The described implementations may also include one or more of the following features. The guide's body may comprise a sleeve defining a throughbore along a longitudinal axis and configured for positioning on the sucker rod. Each vane end may include a first transition from the external surface. Each vane may have angled faces, positioned between the adjacent sidewalls and extending from the first transition at the vane end to a second transition on the vane, each angled face at an acute angle relative to the longitudinal line of symmetry. Each vane may also include an external face between the adjacent sidewalls, extending along the longitudinal line of symmetry. These external faces define a radius of curvature relative to the longitudinal line of symmetry. The adjacent sidewalls on each vane diverge at an acute angle and extend parallel to a radial line of symmetry. The first diameter of the body increases from both the first and second body ends to the lateral line of symmetry at the midpoint, where each trough has a base defined by the first diameter, converging from the vane ends of adjacent vanes to a liminal waist at the midpoint and diverging to the vane ends of adjacent vanes towards the second body end. The sucker rod is disposed on one or more sucker rods.

In another implementation, the guide includes a sleeve, which has sleeve ends, an external surface, a first longitudinal length, and a first diameter. A plurality of vanes symmetrically is arranged about the sleeve's external surface and extend radially outward to a second diameter. Each vane is symmetrical about a longitudinal line of symmetry and a lateral line of symmetry.

The vane ends are separated by a second longitudinal length less than the first longitudinal length. The vane ends have a first transition from the external surface, adjacent sidewalls diverging at a first angle, and angled faces between the sidewalls extending at a second angle from the first transition.

The vane includes an external face disposed between the sidewalls and extends along the longitudinal axis. Troughs with sides are formed by the sidewalls of adjacent vanes. These troughs converge towards the first body end from the vane ends to a constriction at the midpoint and then diverges towards the second body end.

The described implementation may also include one or more of the following features. The adjacent sidewalls for each vane can extend parallel to a radial line of symmetry. The external faces can define a radius of curvature relative to the longitudinal axis. The first and second angles can be defined in specified ranges. For example, the first angle can be in a range of 10 to 15 degrees, and the second angle can be in a range of 20 to 25 degrees. The vanes can be disposed at 90 degrees about the longitudinal axis.

The first diameter of the sleeve can increase from the sleeve ends at a third angle to the lateral line of symmetry. The third angle can be in a range of 1 to 5 degrees. Each trough base can converge from the vane ends to a waist at the midpoint and can diverge towards the second body end. The third angle can also be within a specific range.

Each external face of the vanes can have a diamond shape. The sleeve ends can define a third transition to the first diameter, and both the first and second transitions can be curved. The sleeve and vanes can be made of materials, such as polymeric material, thermoplastic elastomer, thermoset resin, polyurethane, polyamide, composite material, or metallic material. The sleeve can include a throughbore for positioning on the sucker rod.

In yet another implementation, a sucker rod string used to lift fluid in production tubing comprises one or more sucker rods being configured to connect together and comprises one or more guides disclosed above and disposed on the one or more sucker rods.

The foregoing summary is not intended to summarize each potential embodiment or every aspect of the present disclosure.

BRIEF DESCRIPTION OF DRAWINGS

FIGS. 12A to 12D show turbulent intensity calculated for some conventional guides, view from a side thereof.

DETAILED DESCRIPTION OF THE DISCLOSURE

Figures 1A, 1B:
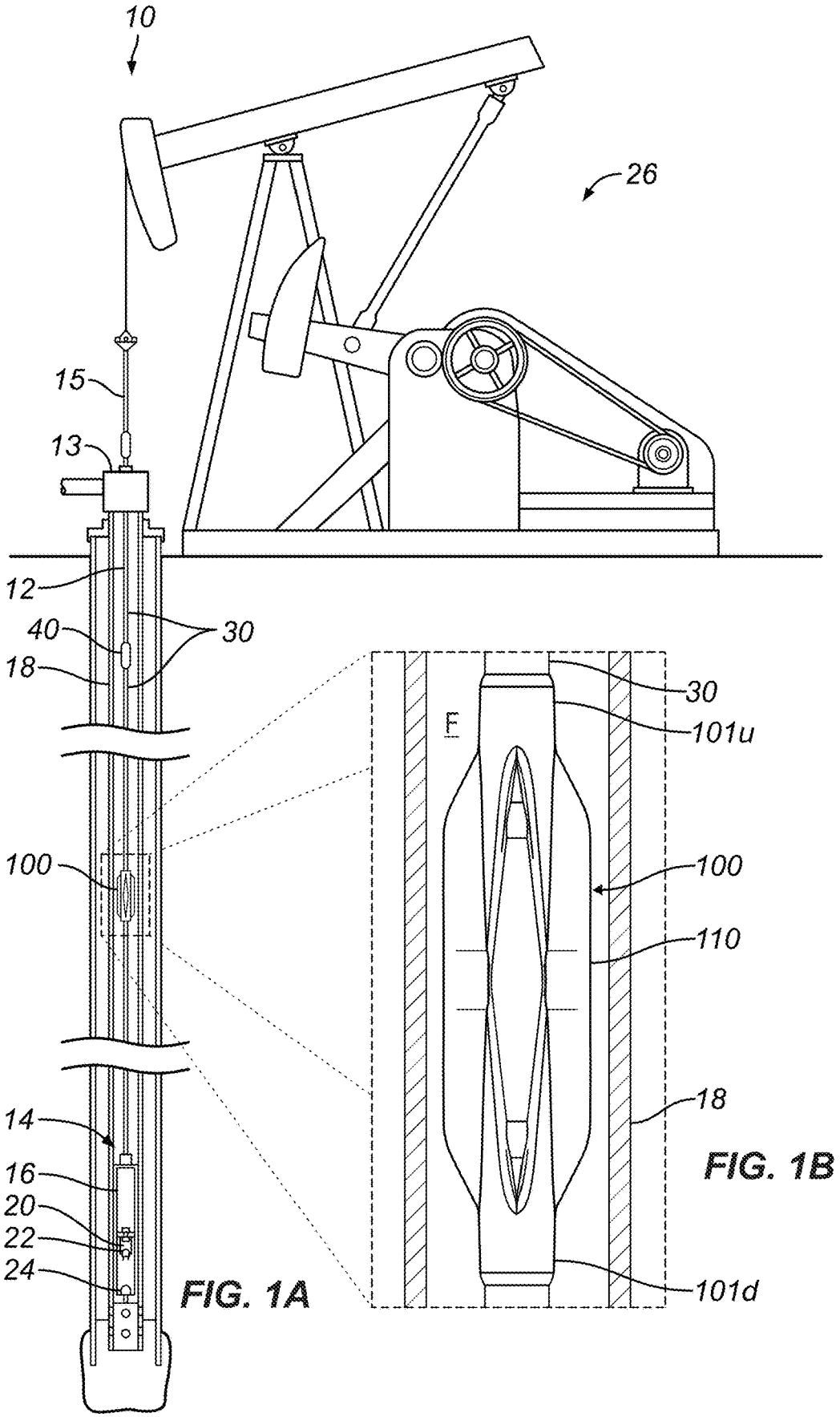
FIG. 1 illustrates a reciprocating rod pump system for which a sucker rod guide according to the present disclosure can be used.

The present disclosure is directed to guides for sucker rods used for pump systems, such as sucker rod pumps or progressive cavity pumps, which extract fluids from a well and employ a downhole pump connected to a driving source at the surface. For example, FIG. 1 shows a reciprocating pump system 10 used to produce fluid from a well. A rod string 12 of sucker rods 30 connects the surface driving force to a downhole pump 14 in the well. In this reciprocating pump system, the downhole pump 14 can be a positive displacement pump that utilizes a standing valve and a travelling valve. When operated, the driving source cyclically raises and lowers a downhole plunger, and with each stroke, the downhole pump lifts well fluids toward the surface.

For instance, the downhole pump 14 has a barrel 16 with a standing valve 24 located at the bottom. The standing valve 24 allows fluid to enter from the wellbore, but does not allow the fluid to leave. Inside the pump barrel 16, a plunger 20 has a traveling valve 22, which allows fluid to move from below the plunger 20 to the production tubing 18 above, but does not allow fluid to return from the tubing 18 to the pump barrel 16 below the plunger 20.

The driving source (e.g., a pump jack or pumping unit 26) at the surface connects by the rod string 12 to the plunger 20 and moves the plunger 20 up and down cyclically in upstrokes and downstrokes to lift fluid to the surface. As shown in FIG. 1, the rod string 12 is comprised of multiple sucker rods 30 connected end-to-end by couplings 40. To help guide and centralize the rod string 12, various sucker rod guides 100 are disposed on the sucker rods 30 of the rod string 12.

A detail of a sucker rod guide 100 according to the present disclosure is depicted in FIG. 1. The sucker rod guide 100 can be made of a polymeric material, a thermoplastic elastomer, a thermoset resin, a polyurethane, a polyamide, a composite material, a metallic material, or another suitable material to withstand the environmental and operational conditions in which the guide 100 is used. The guide 100 is a molded or formed component that fits onto the sucker rod 30 and can be constrained primarily by an interference fit. The sucker rod guide 100 is configured for use with the sucker rods 30 of typical size and construction. For example, the sucker rod 30 is typically made of steel and can have a diameter from ⅝ inch to more than 1 or 1¼ inches. The sucker rod 30 can also have a length of 25 or 30 feet.

The sucker rod guide 100 may be molded onto the sucker rod 30 or may be fitted with an axial slot for installation on the rod 30 in the field. The guide 100 may be retrofitted onto or used with a conventional sucker rod 30. Alternatively, the guide 100 may be used on a dedicated rod or rod section, which may be as long as or shorter than a conventional sucker rod 30.

Vanes 110 on the guide 100 extend in the annular space between the sucker rod 30 and the production tubing 18. As the sucker rod 30 is reciprocated, the guide 100 can act as a circumferential bushing and centralizer that centers the rod string 12 in the production tubing 18. The guide 100 serves as a sacrificial component for riding along the tubing 18 and preventing metal-to-metal contact of the sucker rods 30 and couplings 40 against the tubing 18.

During an upstroke, the fluid column F in the annulus of the production tubing 18 is moved uphole in the tubing 18 as the rod string 12 is lifted. The guide 100 may move together with the lifted fluid column F, as both are lifted during the stroke of the pump jack 26. At the end of the upstroke, the lifted fluid column F stays in place in the production tubing 18. Then, during the down stroke, the rod string 12 and the guide 100 are moved downhole through the fluid column F. In general, the flow velocity of the fluid and the velocity of the sucker rod guide 100 are not necessarily related. In reality, these two velocities can become markedly independent of one another. In a shallow well, for example, a sort of pulsating effect can be produced. In a deeper well, any pulsation may be almost imperceptible.

As the guide 100 moves downhole through the fluid column F, the length of the guide 100 from the downhole end 101*d* toward the uphole end 101*u* disrupts the stationary fluid in the fluid column F, producing differences between higher and lower pressure zones, causing the fluid to flow relative to the guide 100, and producing turbulence especially toward the uphole end 101*u* of the guide 100. The increase in fluid velocity can cause fluid erosion of the sucker rod 30, and low-pressure zones can cause erosion-corrosion and $CO_2$ breakout. The sucker rod guide 100 of the present disclosure is directed to reducing turbulence to mitigate detrimental effects to the sucker rod 30.

As discussed in more detail below, the disclosed sucker rod guide 100 acts as a guard to protect both the sucker rod 30 and the tubing 18—i.e., protecting the tubing's internal surface and protecting the sucker rod body at the periphery of the guide 100. The configuration of the disclosed sucker rod guide 100 pushes the wake of turbulence off from the periphery of the sucker rod guide's ends, without sacrificing the erodible wear volume to be safely worn in protecting the tubing surface as well.

The configuration of the disclosed sucker rod guide 100 has been evaluated utilizing computational flow dynamics simulation software with a special emphasis on the turbulence intensity [%] value and behavior at the edge of the geometry and on the surface of the sucker rod. This configuration of the disclosed sucker rod guide 100 accelerates the flow in the middle of the geometry and generates a smooth deceleration at the ends. The configuration produces flow with a reduced separation in the boundary layer around the whole volume of the guide's geometry, and the configuration allows different velocity flow streams to reconnect with one another before leaving the sucker rod guard's geometry. The resulting flow produced by the guide 100 reduces the impact on the sucker rod body at the periphery of the guide 100.

Figure 2:
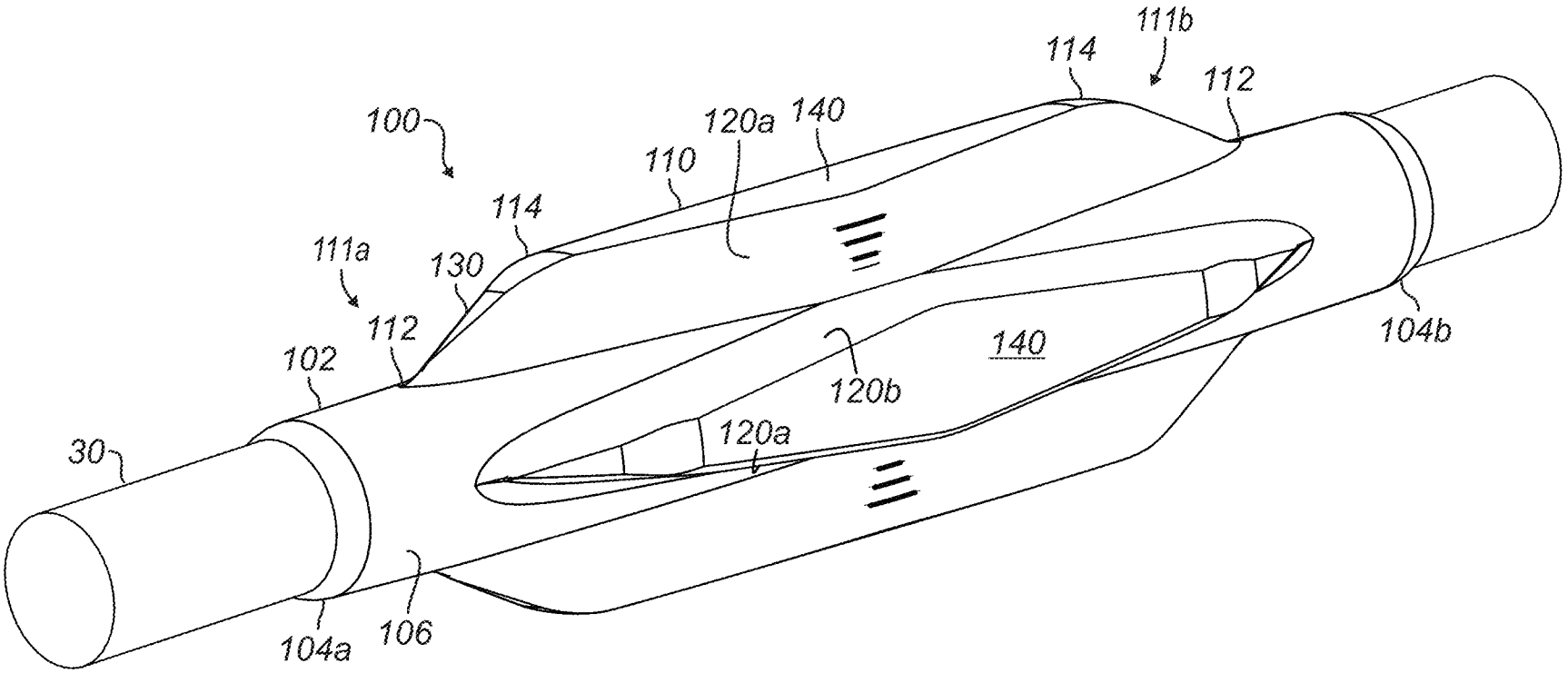
FIG. 2 illustrates a perspective view of a sucker rod guide according to the present disclosure.

FIG. 2 illustrates a perspective view of a sucker rod guide 100 according to the present disclosure. The guide 100 includes a body or sleeve 102 and a plurality of vanes 110. As shown, the guide 100 includes four vanes 110, although more or less could be used depending on the implementation.

The body 102, which can be a sleeve, is configured to position on the sucker rod 30. The body or sleeve 102 has ends 104*a-b*, and an external surface 106. The vanes are disposed symmetrically about the external surface 106 of the sleeve 102 and extend radially outward. Each of the vanes 110 has vane ends 111*a-b*, adjacent sidewalls 120*a-b*, angled faces 130, and an external face 140. At each vane end 111*a-b*, each vane 110 transitions with a first transition 112 from the sleeve's external surface 106. The adjacent sidewalls 120*a-b* at each of the vane ends 111*a-b* diverge from one another starting at the first transition 112 and extend to a middle section of the sleeve 102. At each vane end 111*a-b*, each angled face disposed between the adjacent sidewalls 120*a-b* extends from the first transition 112 outward from the sleeve's external surface 106 to a second transition 114. Finally, the external face of each vane 110 disposed between the adjacent sidewalls 120*a-b* extends between the second transitions 114.

Further details of the guide 100 are illustrated in FIGS. 3, 4, 5, 6, and 7A-7B. As noted above, the body 102 is configured to position on the sucker rod. As shown here in the cross-sectional view of FIGS. 4 and 6 as well as the end views of FIGS. 7A and 7B, the body 102 can be a sleeve defining a throughbore 105 therethrough. The throughbore 105 extends along a longitudinal axis A and is configured to position on the sucker rod (not shown).

Figure 3:
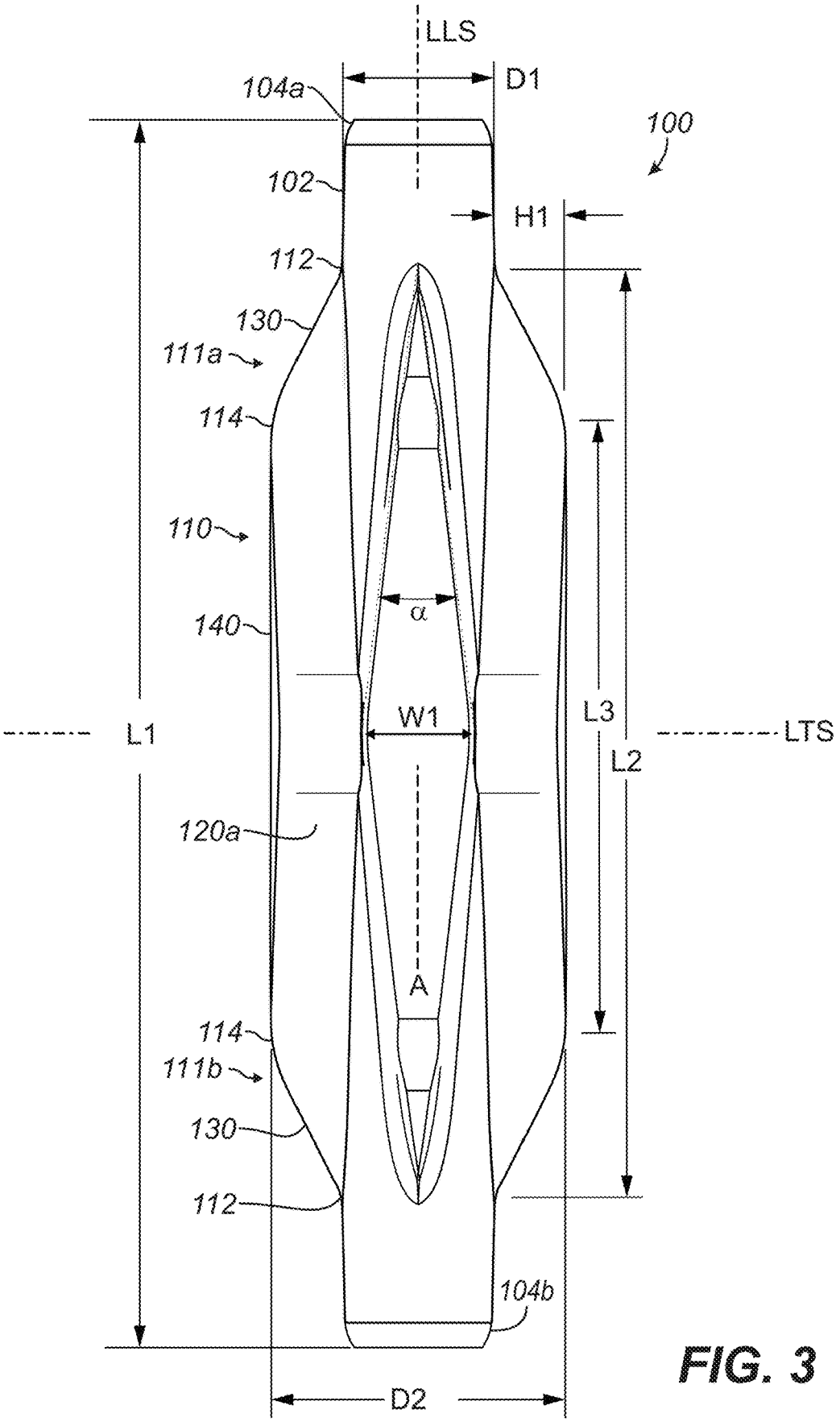
FIG. 3 illustrates an elevational view of the disclosed guide.

The sleeve as shown in FIG. 3 has a first diameter D1 and a first longitudinal length L1. The ends can define a translation from the throughbore 105 to the first diameter D1. The length of this transition can depend on the difference in the throughbore's diameter and the first dimension. Preferably, the transition is gradual.

As further shown in FIG. 3, the vanes 110 disposed symmetrically about the external surface 106 of the sleeve 102 extend radially outward at a height H1 so the vanes 110 have a second diameter D2 on the guide 100. Each of the vanes 110 is symmetrical on both sides of a longitudinal line of symmetry (LLS) and is symmetrical on both sides of a lateral line of symmetry (LTS) at a midpoint of the longitudinal line of symmetry (LLS).

The vane ends 111*a-b* of the vanes 110 at the first transitions 112 are separated by a second longitudinal length L2, which is less than the first longitudinal length L1.

The adjacent sidewalls 120*a-b* on the vanes 110 diverge from one another at a first angle (a). The adjacent sidewalls 120*a-b* extend from the first transitions 112 to the lateral line of symmetry (LLS) at the midpoint of the longitudinal line of symmetry (LLS). As a result, the vanes 110 have a diamond shape with pointed ends and with a width W1 at their midpoints.

Figure 4:
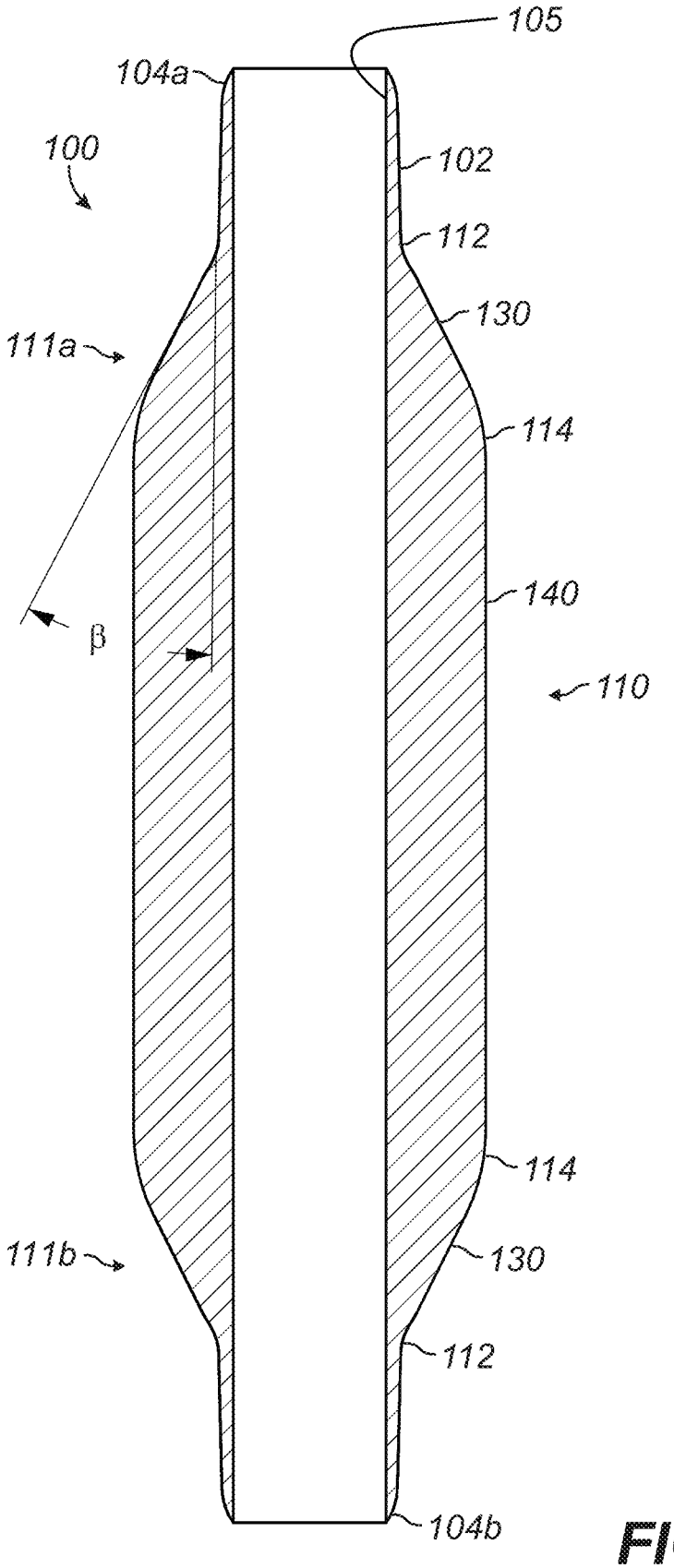
FIG. 4 illustrates a cross-sectional view of the disclosed guide.
Figure 5:
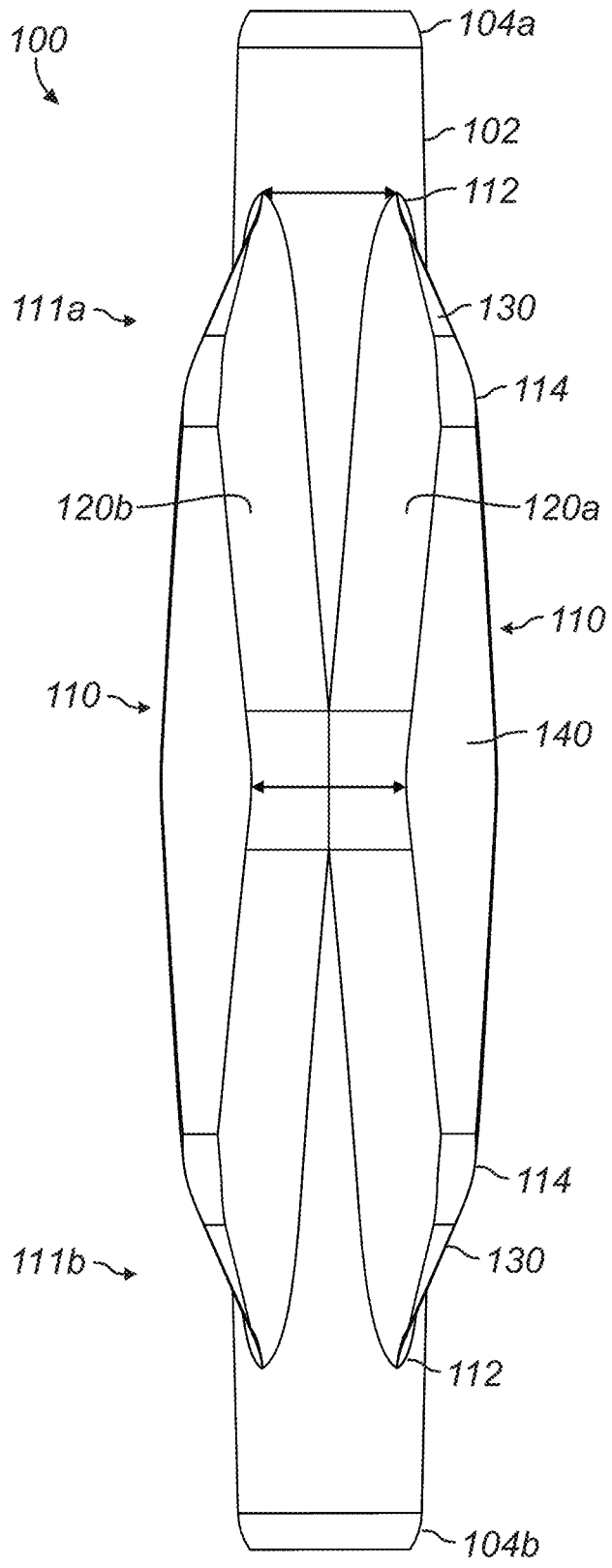
FIG. 5 illustrates another elevational view of the disclosed guide, turned at 45 degrees from the orientation in FIG. 3.

As shown in FIG. 4, the angled faces extend at a second angle (B) from the first transition 112 relative to the longitudinal axis to the second transition 114.

As shown in FIG. 3, the external faces 140 of the vanes 110 disposed between the adjacent sidewalls 120*a-b* extend a length L3 along the longitudinal axis A between the second transitions 114.

Figure 7A:
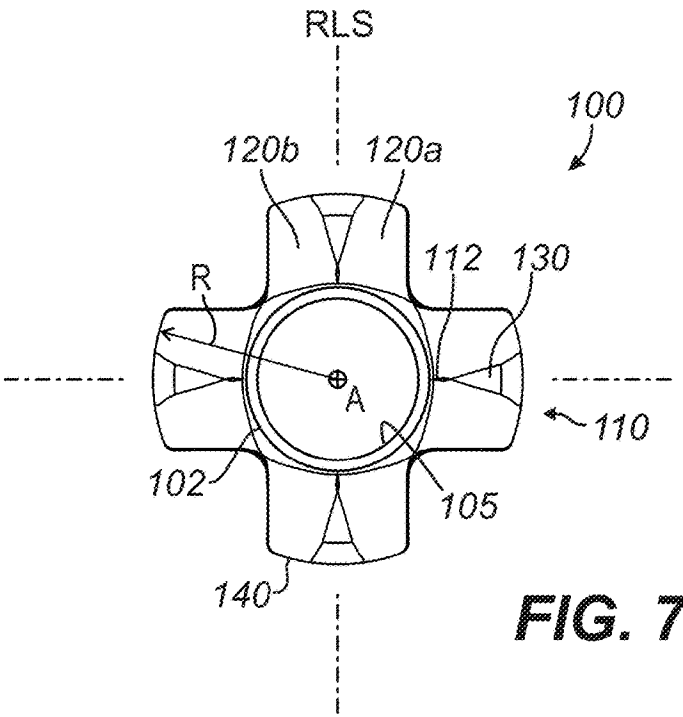
FIG. 7A illustrates an end view of the disclosed guide.
Figure 7B:
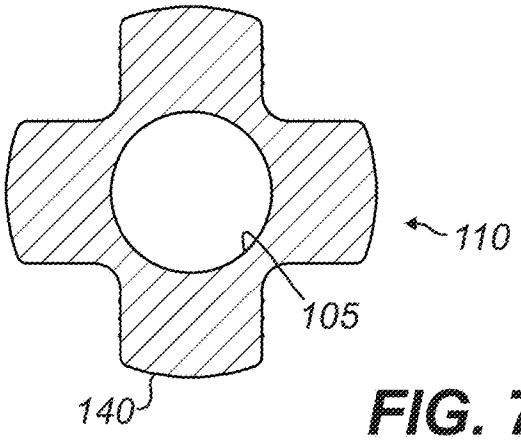
FIG. 7B illustrates an end cross-section of the disclosed guide.
Figure 9A:
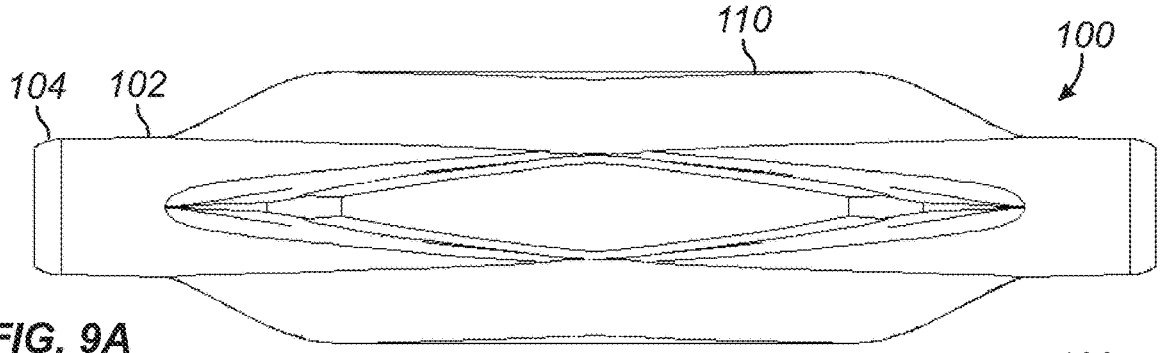
FIGS. 9A to 9E show examples of the guide for use with different combinations of sucker rod and tubing sizes.
Figure 9B:
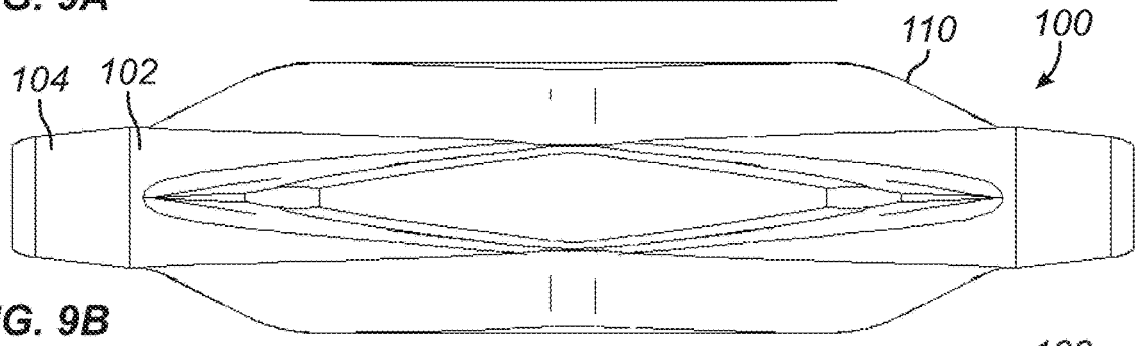
Figure 9C:
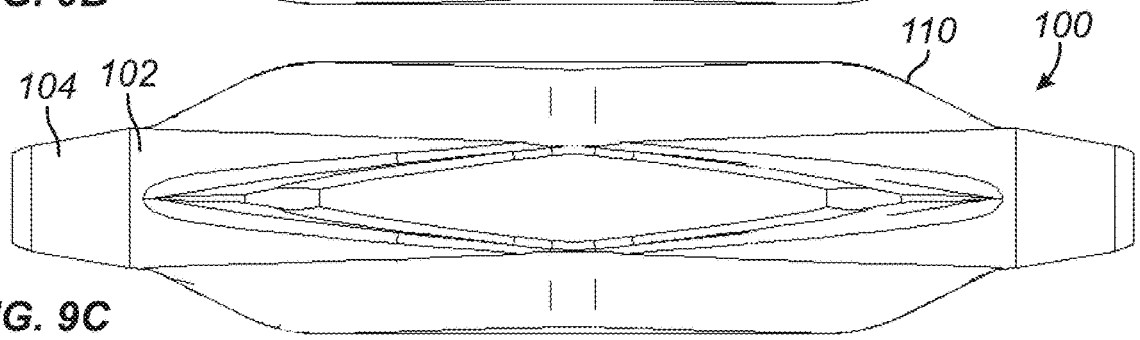
Figure 9D:
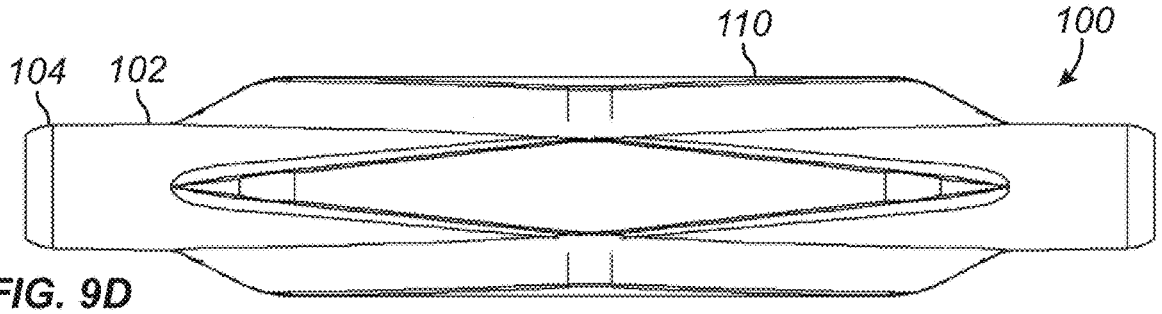
Figure 9E:
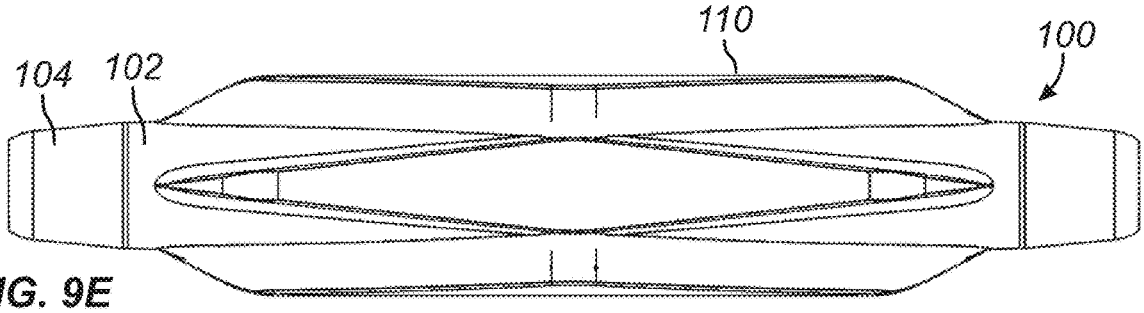
Figure 10C:
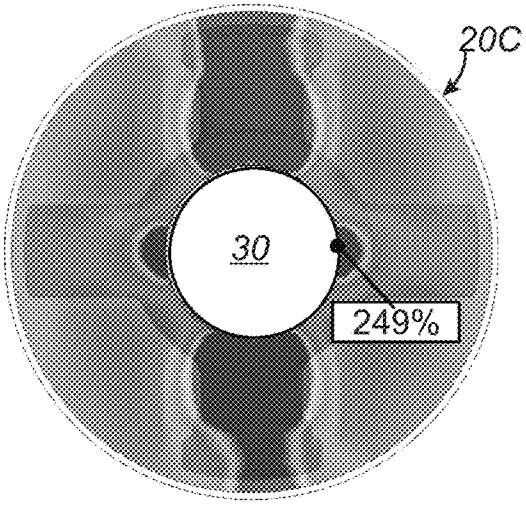
FIGS. 10A to 10D show turbulent intensity calculated for some conventional guides, viewed from an end thereof.
Figure 10B:
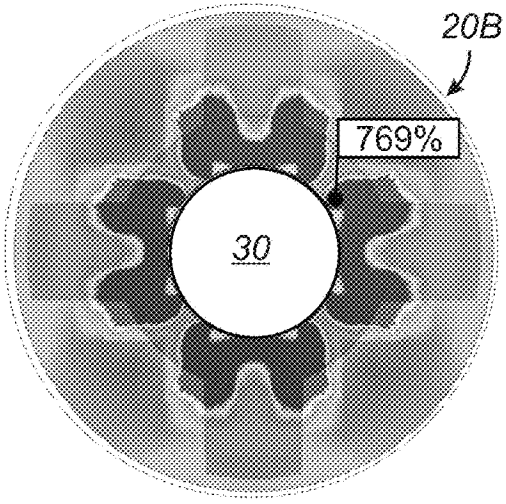
Figure 10A:
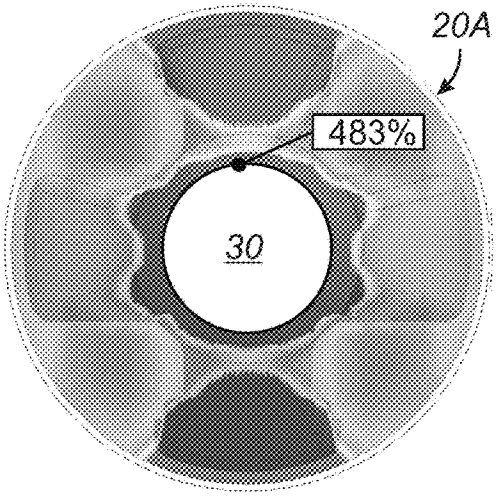

As shown in FIGS. 7A and 7B, four vanes 110 are disposed at 90 degrees about the longitudinal axis A, whereby the four vanes 110 are arranged at four radial lines of symmetry (RLS). As also shown, each of the adjacent sidewalls 120*a-b* for the vanes 110 can extend parallel to the radial line of symmetry (RLS). Additionally, each of the external faces 140 defines a radius of curvature (R) relative to the longitudinal axis of the body.

Figure 6:
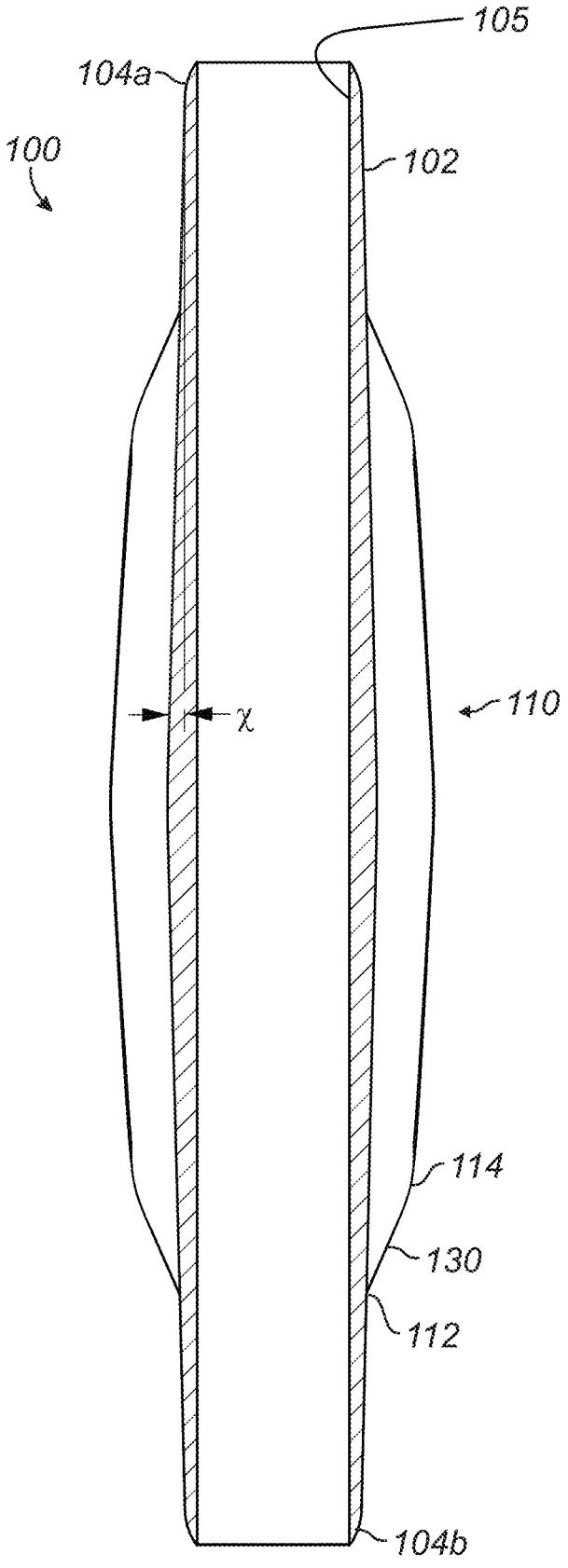
FIG. 6 illustrates another cross-sectional view of the disclosed guide.

As best shown in the cross-section of FIG. 6, the first diameter D1 of the external surface 106 of the sleeve 102 can increase slightly from each of the ends at a third angle ($\chi$) to the lateral line of symmetry (LTS) at the midpoint of the longitudinal line of symmetry (LLS).

Figure 8:
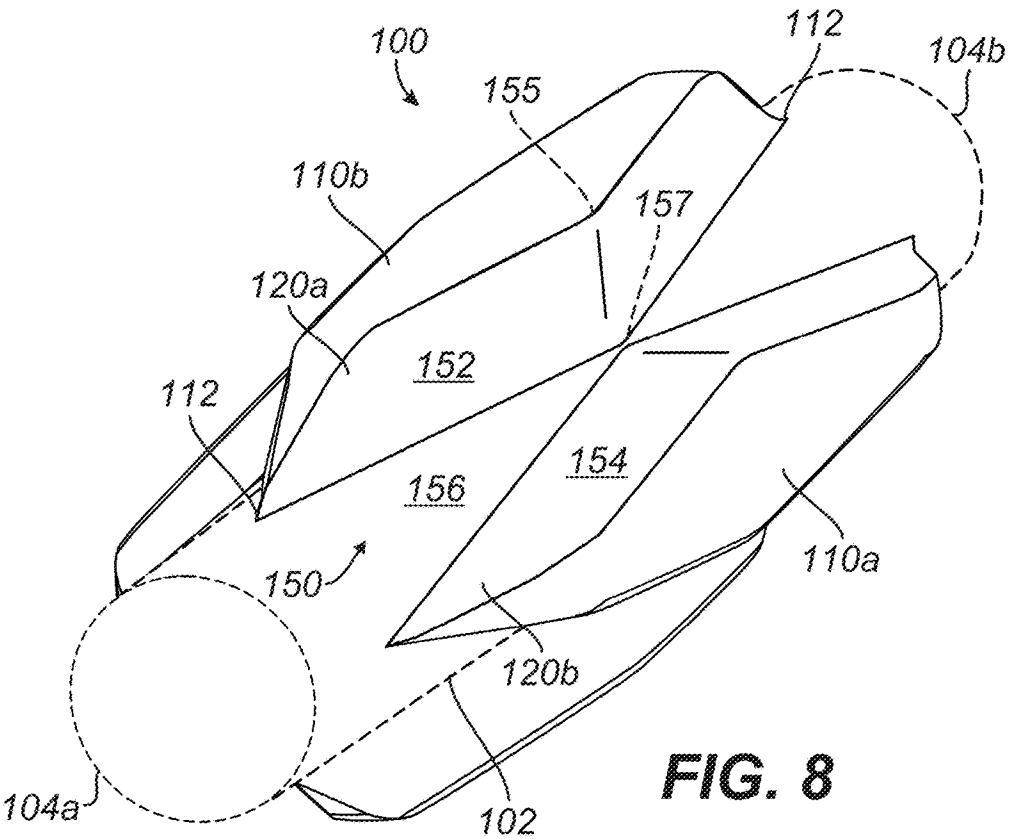
FIG. 8 illustrates a schematic view of the disclosed guide.

Turing now to FIG. 8, discussion turns to the space or trough 150 between adjacent vanes 110*a-b* on the disclosed guide 100. The configuration of the disclosed guide defines troughs 150 between the vanes 110 of the guide 100. In this example, the disclosed guide 100 has four vanes 110, which equates to four troughs 150. Discussion of one of the troughs 150 is presented here.

As noted, each of the vanes 110 is symmetrical about a longitudinal line of symmetry, and each of the vanes 110 is symmetrical about a lateral line of symmetry at a midpoint of the longitudinal line of symmetry. Each of the vanes 110 has adjacent sidewalls 120*a-b* at each vane end 111*a-b* of each vane 110.

Each trough 150 has sides 152, 154 formed by the sidewalls 120*a-b* of adjacent ones of the vanes 110*a-b*. The sides 152, 154 of the trough 150 toward the first body end 104*a* converge from the first of the vane ends 111*a* of the adjacent vanes 110*a-b* to a liminal constriction 155 at the midpoint (of lateral symmetry). The sides 152, 154 of the trough 150 then diverge directly from the liminal constriction 155 to the second of the vane ends 111*b* of the adjacent vanes 110*a-b* toward the second body end 104*b*.

As further noted, the diameter of the body 102 increases from each body end 104*a-b* to the lateral line of symmetry at the midpoint. Accordingly, the trough 150 has a base 156 defined by the diameter of the body 102. The base 156 toward the first body end 104*a* converges at least from the first the vane ends 111*a* of the adjacent vanes 110*a-b* to a liminal waist 157 at the midpoint and diverges directly from the liminal waist 157 at least to the second of the vane ends 111*b* of the adjacent vanes 110*a-b* toward the second body end 104*b*.

The configuration disclosed above controls the flow of fluid along the guide 100 to provide the benefits described herein. As discussed herein, the fluid flow is rearranged in the wake of the guide 100 to reduce the risk of localized corrosion to the sucker rod surface at the periphery of the sucker rod guide.

Certain dimensions of the guide 100 depend on the type of sucker rod for which it is used and the size of the production tubing in which it is installed. In that regard, the tubing sizes most commonly used for rod-pumped wells include: 2-38 inches, 2⅞ inches, 3½ inches, and 4½ inches, which are selected based on factors such as well depth, production rate, and the specific conditions of the reservoir. Meanwhile, the sucker rod can have a diameter from ⅝ inch to more than 1 or 1¼ inches. Accordingly, as one example, a sucker rod with a ⅞-inch diameter may be used in production tubing having an outside diameter of 2⅞ inches so that the sizing of the disclosed guide 100 would be configured for use with these and other dimensions.

For example, FIGS. 9A to 9E show examples of the guide 100 for uses with different combinations of sucker rod and tubing sizes, including, for example, 1-in. rod diameter in 2⅞-in. OD tubing, a ⅞-in. rod diameter in 2⅞-in. OD tubing, a ¾-in. rod diameter in 2⅞-in. OD tubing, a ⅞-in. rod diameter in 2⅜-in. OD tubing, a ¾-in. rod diameter in 2⅜-in. OD tubing, etc.

As can be seen here, the overall lengths of the guides can be consistent with one another in these examples. The outer diameters D2 of the guides 100 are consistent for the same OD tubing sizes. For example, the guides 100 in FIGS. 9A, 9B, and 9C for the 2⅞-in. OD tubing have comparable outside diameter D2, while the guides 100 in FIGS. 9D and 9E for the 2⅜-in. OD tubing have comparable outside diameter D2. The diameter of the throughbores of the guides 100 can differ from based on the rod diameter, but the diameter D1 of the external surface 106 on the sleeves 102 can generally be comparable to one another for each of the similarly sized OD tubing. The end transitions (112) may merely be modified to account for the transition from the different sized throughbores to the sleeve diameters. Thus, for the comparably sized guides 100 in FIGS. 9A to 9C, the transitions (112) at the ends (111*a-b*) are simply altered to account for the sleeve diameter D1 to the smaller sucker rod dimensions. The same is true for the other guides 100 in FIGS. 9D and 9E. Yet, the sleeve diameter and vane diameters for these guides 100 are suitably reduced to accommodate the smaller tubing OD.

In general, the length L1 of the sleeve 102 can have sizes of about 5 inches to about 12 inches. The diameter D1 of the sleeve 102 can be about 0.625 inches to 1.750 inches. With respect to these sizes, the lengths L2 of the vanes are less than L1 and can be about 4 inches to 11 inches. The outer diameter D2 of the guide 100 at the external faces 140 of the vanes 110 can have sizes of about 1 inch to 3.5 inches.

For one implementation of the guide 100, the first angle (a) can be an acute angle of about 10 to 15 degrees, and the second angle (B) can be an acute angle of about 20 to 25 degrees. The third angle (x) can be an acute angle of about 1 to 5 degrees.

Because the guide 100 is used downhole in production tubing, the external faces 140 on the vanes 110 of the guide 100 are configured to provide a suitable sweep perimeter. In general, given as a percentage of 360-degree coverage, the sweep perimeter can be about 50%.

Additionally, the guide's geometry and symmetrical configuration noted above seeks to reduce turbulence intensity in the transition between guide 100 and rod body. It is believed that the disclosed geometry and configuration can produce a ten-fold improvement compared to typical guides.

As discussed in the background of the present disclosure, for instance, failure analysis shows that the flow around a convention sucker rod guide can produce a significant number of rod failures at the periphery of the guide. Evaluations have identified erosion-corrosion patterns in failure samples and use Computational fluid dynamics (CFD) to assist in the validation and posterior solution design. CFD analysis has produced quantitative predictions of fluid-flow phenomena based on the conservation laws (conservation of mass, momentum, and energy) governing fluid motion.

Using CFD evaluation, the geometry and symmetrical configuration of the guide 100 disclosed herein has been developed to minimize the turbulence and the appearance of vortexes at the edges of the guide 100. Particular emphasis has been made to reduce turbulent events from the transition of the guide 100 to the rod body.

As noted previously, failure analysis shows that sucker rod body failures in the periphery of the sucker rod guides are typically associated with these main factors: corrosion-erosion, corrosion-fatigue, and excessive bending. Flow analysis to improve the design of the disclosed guides has taken parameters into account, which include reducing turbulence (turbulent intensity and kinetic energy) downstream of the guide and focusing on the transition of the flow conditions of the guide end to the rod-surface.

Figure 11:
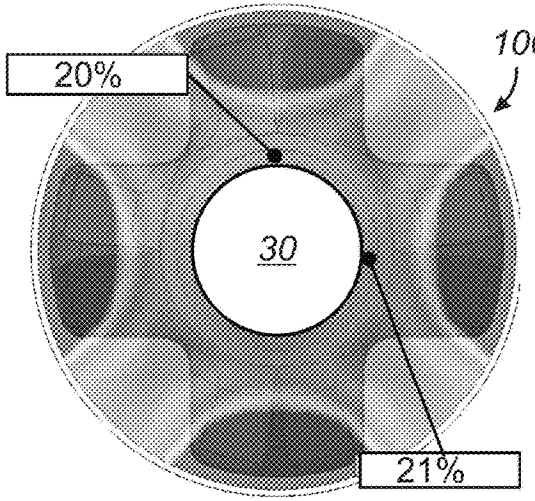
FIG. 11 shows turbulent intensity calculated for the disclosed guide, viewed from an end thereof.
Figure 10D:
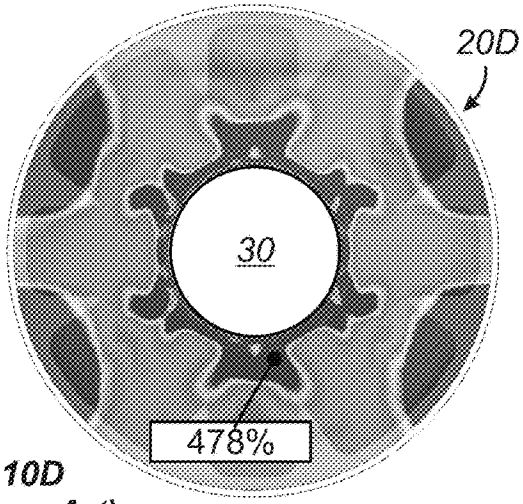

Some details of fluid analysis for the guide 100 disclosed herein are illustrated with reference to FIGS. 11, 13, and 15. The fluid analysis uses a parameter of turbulence intensity ($T_u$), which is used in the field of Computational Fluid Dynamics (CFD) to characterize the level of turbulence within a flow field. In fluid dynamics, turbulence refers to the chaotic and irregular motion of fluid particles. The turbulence intensity ($T_u$) evaluates fluid velocity fluctuations over time, which indicates the intensity of eddy or vortex generations in a turbulent flow of particles. The turbulence intensity is given by:

$$T_u = \frac{\sqrt{\overline{u'^2}}}{\overline{U}}$$

In general, the turbulence intensity is a ratio of (i) the Root-Mean-Square (RMS) or Standard Deviation of the turbulent velocity fluctuations at a particular location over a specified period of time relative to (ii) the average of the velocity at the same location over same time period. Turbulence intensity above 100% means that the velocity fluctuations at the outlet have velocity changes/fluctuations in the order of the mean velocity. Turbulence intensity of 20% or above could be considered high for some applications.

FIGS. 10A to 10D show turbulent intensity calculated for some conventional guides 20A-20D, viewed from an end thereof. These conventional examples are shown relative to the turbulent intensity calculated for the disclosed guide 100 depicted in FIG. 11. Values of the calculated turbulent intensity are investigated around the rod 30 at the guide's edge. For the conventional guides 20A-20D in FIGS. 10A to 10D, the turbulent intensity is calculated to have values of 483%, 769%, 249%, and 478%, which are considerably higher than the calculated value of 21% for the disclosed guide 100 in FIG. 11.

Figure 13:
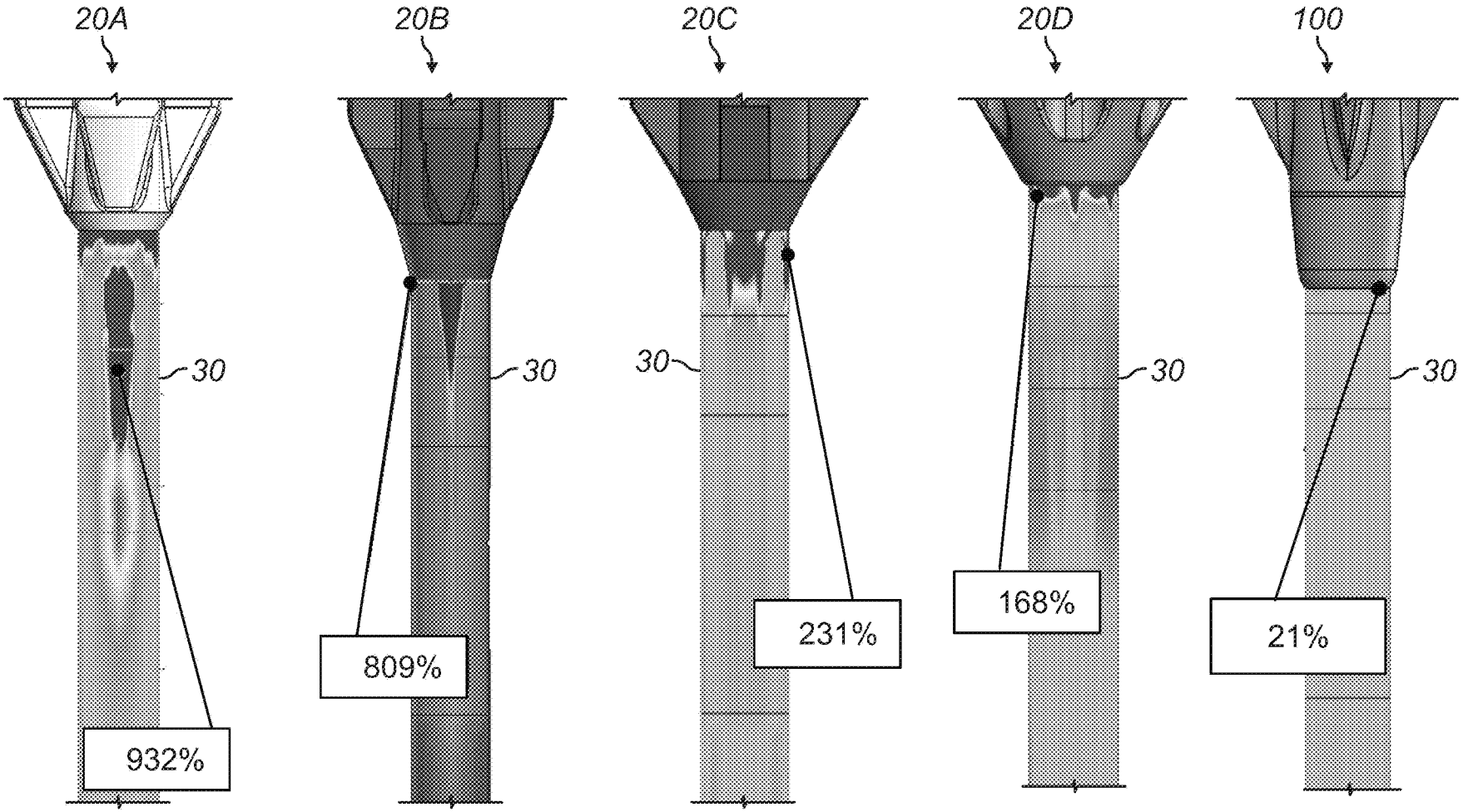
FIG. 13 shows turbulent intensity calculated for the disclosed guide, viewed from a side thereof.

Viewed from the side, FIGS. 12A to 12D show turbulent intensity calculated for some conventional guides 20A-20D relative to turbulent intensity calculated for the disclosed guide 100 depicted in FIG. 13. Values of the calculated turbulent intensity are investigated along the rod 30 downstream from the guide's edge. For the conventional guides 20A-20D in FIGS. 12A to 12D, the turbulent intensity is calculated at some points to have values of 932%, 809%, 231%, and 168%, which are considerably higher than the calculated value of 21% for the disclosed guide 100 in FIG. 13.

Figure 15:
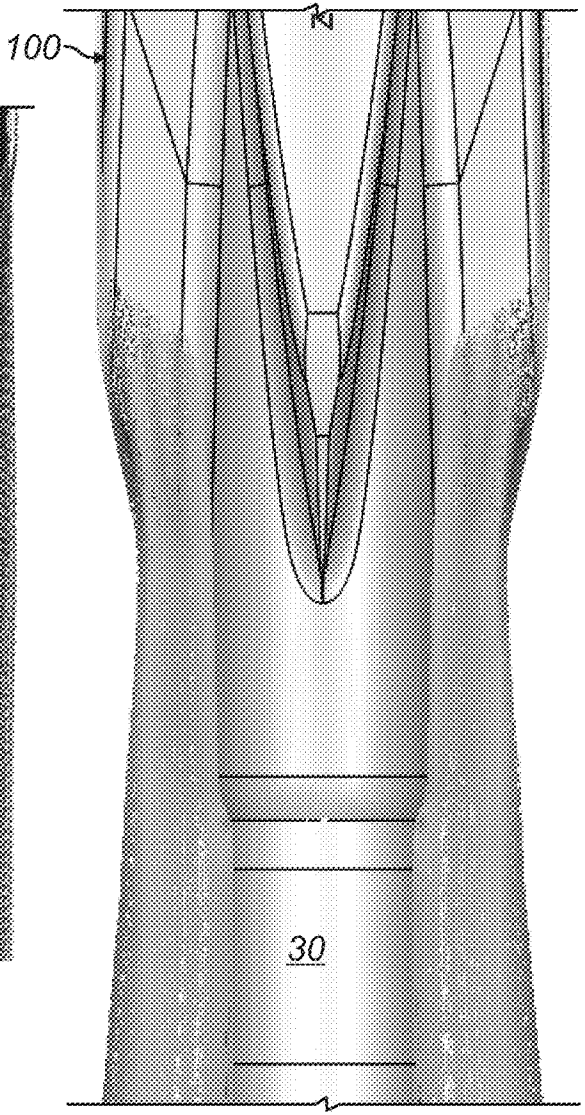
FIG. 15 shows flow velocities for the flow along the rod downstream of the disclosed guide.
Figure 14B:
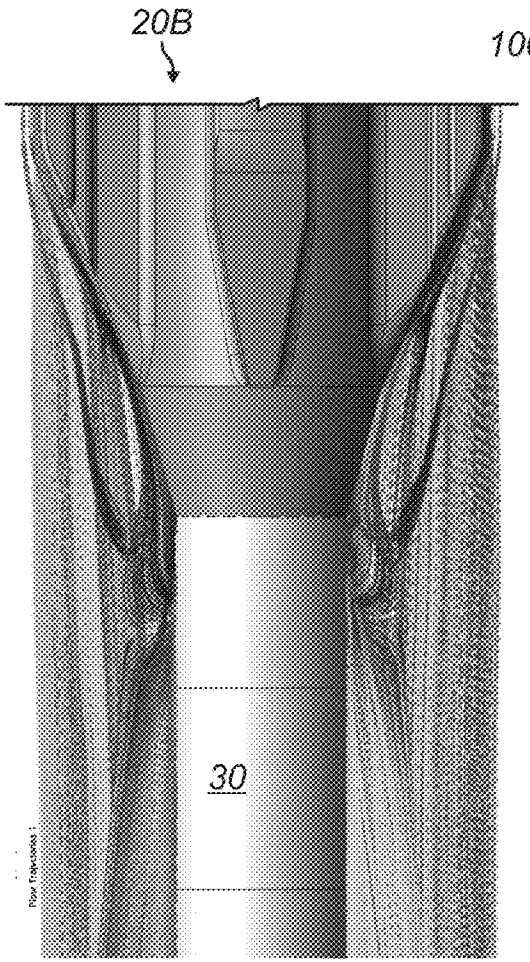
FIGS. 14A and 14B show flow velocities for the flow along the rod downstream of the conventional guides.
Figure 14A:
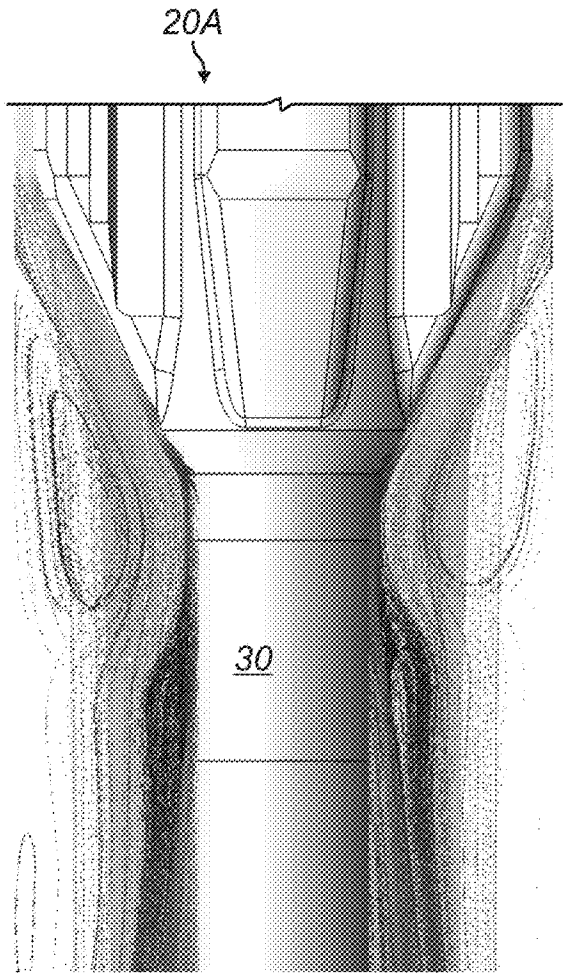

As a further illustration, FIGS. 14A and 14B show flow velocities for the flow along the sucker rod 30 downstream of the conventional guides 20A-20B relative to flow velocities for the disclosed guide 100 in FIG. 15.

Based on the specifics discussed above, the disclosed sucker rod guide 100 can distribute/arrange/direct/control fluid flow to prevent turbulence outbreaks around the rod's periphery. In particular, the geometric configuration of the guide 100 facilitates fluid flow rearrangement in the wake of the guide 100. The guide 100 can reduce the risk of localized corrosion to the sucker rod surface in the periphery of the sucker rod guide. This is evidenced by the use of CFD, which indicates the turbulence intensity percentage at that region with a percentage below about 30%. This is at least ten times smaller than the turbulence intensity generated by other conventional sucker rod guides.

The guide 100 provides a wide sweep length/angle without requiring flow twisting, which is a departure from conventional slant geometries employed in conventional sucker rod guides. The geometric configuration of the guide 100 can enhance paraffin scraping capabilities and can promote improved contact sweep, which can be particularly beneficial for integrating self-lubricant additives in polymers such as silicon, graphite, moly, and Teflon.

Additionally, the dimensions of the guide, such as its length and tapered ends, play a role in distributing bending moments across the rod body edge, ensuring structural integrity and stability. For example, the guide's localized center of mass reduces stiffness at the ends, minimizing bending moment-induced stresses and extending bending support to the rod. The guide's thicker transition further enhances structural integrity and provides a reliable seal. Moreover, the guide's configuration seeks to optimize the contact area between the rod and guide, thereby maximizing detachment. This can be beneficial in environments having high side loads, mitigating the risk of premature stripping of fiber materials downhole.

Finally, the disclosed guide 100 aims to deliver an Equivalent Wear Volume (EWV) compared to conventional guides and can provide consistent performance and reliability in sucker rod applications. The guide 100 can incorporate wear gauge indications to monitor even wear distribution, particularly crucial when utilized on a rod rotator. While some guides may exhibit uneven wear patterns, the gauge serves as a reference point for maintenance and performance assessment.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A guide for use on a sucker rod, the sucker rod used to lift fluid in production tubing, the guide comprising:

a body configured to position on the sucker rod, the body having an external surface, first and second body ends, and a first diameter; and a plurality of vanes disposed about the external surface of the body and extending radially outward to a second diameter, the second diameter being greater than the first diameter, each of the vanes being symmetrical about a longitudinal line of symmetry, each of the vanes being symmetrical about a lateral line of symmetry at a midpoint of the longitudinal line of symmetry, each of the vanes having adjacent sidewalls at each of first and second vane ends of each vane, the adjacent sidewalls at each of the first and second vane ends diverging from one another extending to the lateral line of symmetry at the midpoint of the longitudinal line of symmetry, the adjacent sidewalls from each of the first vane ends meeting at the lateral line of symmetry with the adjacent sidewalls from the respective second vane ends, whereby the guide defines troughs having sides formed by the sidewalls of adjacent ones of the vanes, the sides of each trough toward the first body end converging from the first vane ends of the adjacent vanes to a liminal constriction at the midpoint and diverging directly from the liminal constriction to the second vane ends of the adjacent vanes toward the second body end.

2. The guide of claim 1, wherein the body comprises a sleeve defining a throughbore therethrough, the throughbore extending along a longitudinal axis of the sleeve and being configured to position on the sucker rod.

3. The guide of claim 1, wherein each of the first and second vane ends comprises a first transition from the external surface.

4. The guide of claim 3, wherein each of the vanes comprises angled faces, each disposed between the adjacent sidewalls and extending from the first transition at the respective first and second vane end of the vane to a second transition on the vane, each angled face extending at an acute angle relative to the longitudinal line of symmetry.

5. The guide of claim 1, wherein each of the vanes comprises an external face disposed between the adjacent sidewalls and extending along the longitudinal line of symmetry.

6. The guide of claim 5, wherein each of the external faces defines a radius of curvature relative to the longitudinal line of symmetry of the body.

7. The guide of claim 1, wherein the adjacent sidewalls on each vane diverge from one another at an acute angle.

8. The guide of claim 1, wherein each of the adjacent sidewalls extends parallel to a radial line of symmetry.

9. The guide of claim 1, wherein the first diameter of the body increases from each first and second body end of the body to the lateral line of symmetry at the midpoint of the longitudinal line of symmetry, whereby each trough has a base defined by the first diameter of the body, the base toward the first body end converging at least from the first and second vane ends of the adjacent vanes to a liminal waist at the midpoint and diverging directly from the liminal waist at least to the first and second vane ends of the adjacent vanes toward the second body end.

10. A sucker rod string used to lift fluid in production tubing, the sucker rod string comprising:

one or more sucker rods being configured to connect together; and one or more guides according to claim 1 disposed on the one or more sucker rods.

11. A guide for use on a sucker rod, the sucker rod used to lift fluid in production tubing, the guide comprising:

a sleeve configured to position on the sucker rod, the sleeve having first and second sleeve ends, an external surface, a first longitudinal length along a longitudinal axis between the first and second sleeve ends, and a first diameter; and a plurality of vanes symmetrically disposed about the external surface of the sleeve and extending radially outward to a second diameter, each of the vanes being symmetrical about a longitudinal line of symmetry, each of the vanes being symmetrical about a lateral line of symmetry at a midpoint of the longitudinal line of symmetry, each of the vanes having:

vane ends separated by a second longitudinal length less than the first longitudinal length, each of the vane ends having a first transition from the external surface;

adjacent sidewalls at each of the vane ends, the adjacent sidewalls diverging from one another at a first angle, the adjacent sidewalls extending from the first transition to the lateral line of symmetry at the midpoint of the longitudinal line of symmetry;

angled faces, each disposed between the adjacent sidewalls and extending at a second angle from the first transition relative to the longitudinal axis to a second transition; and an external face disposed between the adjacent sidewalls and extending along the longitudinal axis between the second transitions, whereby the guide defines troughs having sides formed by the sidewalls of adjacent ones of the vanes, the sides of each trough toward the first sleeve end converging from the vane ends of the adjacent vanes to a constriction at the midpoint and diverging directly from the constriction to the vane ends of the adjacent vanes toward the second sleeve end.

12. The guide of claim 11, wherein each of the adjacent sidewalls for a given one of the vanes extend parallel to a radial line of symmetry.

13. The guide of claim 11, wherein each of the external faces defines a radius of curvature relative to the longitudinal axis of the sleeve.

14. The guide of claim 11, wherein the first angle is in a range of 10 to 15 degrees.

15. The guide of claim 11, wherein the second angle is in a range of 20 to 25 degrees.

16. The guide of claim 11, wherein four of the vanes are disposed at 90 degrees about the longitudinal axis, whereby the four vanes are arranged at four radial lines of symmetry.

17. The guide of claim 11, wherein the first diameter of the sleeve increases from each of the first and second sleeve ends at a third angle to the lateral line of symmetry at the midpoint of the longitudinal line of symmetry, whereby each trough has a base defined by the first diameter of the sleeve, the base toward the first sleeve end converging at least from the vane ends of the adjacent vanes to a waist at the midpoint and diverging directly from the waist at least to the vane ends of the adjacent vanes toward the second sleeve end.

18. The guide of claim 17, wherein the third angle is in a range of 1 to 5 degrees.

19. The guide of claim 11, wherein each external face of the vanes has a diamond shape.

20. The guide of claim 19, wherein each of the first and second sleeve ends defines a third transition to the first diameter.

21. The guide of claim 11, wherein the first transition is curved, and wherein the second transition is curved.

22. The guide of claim 11, wherein the sleeve and the vanes are integrally formed of a material selected from the group consisting of a polymeric material, a thermoplastic elastomer, a thermoset resin, a polyurethane, a polyamide, a composite material, and a metallic material.

23. The guide of claim 11, wherein the sleeve defines a throughbore configured to position on the sucker rod.

24. A sucker rod string used to lift fluid in production tubing, the sucker rod string comprising:

one or more sucker rods being configured to connect together; and one or more guides according to claim 11 disposed on the one or more sucker rods.

25. A guide for use on a sucker rod, the sucker rod used to lift fluid in production tubing, the guide comprising:

a body configured to position on the sucker rod, the body having an external surface, first and second body ends, and a first diameter, the first diameter of the body increases from each first and second body end of the body to a lateral line of symmetry at a midpoint of a longitudinal line of symmetry; and a plurality of vanes disposed about the external surface of the body and extending radially outward to a second diameter, the second diameter being greater than the first diameter, each of the vanes being symmetrical about the longitudinal line of symmetry, each of the vanes being symmetrical about the lateral line of symmetry at the midpoint of the longitudinal line of symmetry, each of the vanes having adjacent sidewalls at each of first and second vane ends of each vane, the adjacent sidewalls at each of the first and second vane ends diverging from one another from and extending to the lateral line of symmetry at the midpoint of the longitudinal line of symmetry, whereby the guide defines troughs having sides formed by the sidewalls of adjacent ones of the vanes, the sides of each trough toward the first body end converging from the first and second vane ends of the adjacent vanes to a liminal constriction at the midpoint and diverging directly from the liminal constriction to the first and second vane ends of the adjacent vanes toward the second body end, and whereby each trough has a base defined by the first diameter of the body, the base toward the first body end converging at least from the first and second vane ends of the adjacent vanes to a liminal waist at the midpoint and diverging directly from the liminal waist at least to the first and second vane ends of the adjacent vanes toward the second body end.

26. The guide of claim 25, wherein each of the vanes has:

first transition from the external surface at the first and second vane ends;

angled faces, each disposed between the adjacent sidewalls and extending at an angle from the first transition to a second transition; and an external face disposed between the adjacent sidewalls and extending between the second transitions.

27. The guide of claim 26, wherein at least one of:

each of the external faces defines a radius of curvature relative to the longitudinal line of symmetry of the body;

the adjacent sidewalls on each vane diverge from one another at an acute angle;

each of the adjacent sidewalls extend parallel to a radial line of symmetry; and each external face of the vanes has a diamond shape.

* * * * *